United States Patent [19]

Christiansen et al.

[11] 4,205,482

[45] Jun. 3, 1980

[54] TOY FIGURE

[75] Inventors: Godtfred K. Christiansen; Jens N. Knudsen, both of Billund; Erik P. Tapdrup, Sorgenfri near Virum, all of Denmark

[73] Assignee: Interlego A.G., Baar, Switzerland

[21] Appl. No.: 935,761

[22] Filed: Aug. 22, 1978

[30] Foreign Application Priority Data

Aug. 29, 1977 [DK] Denmark ..... 3818/77
May 2, 1978 [DK] Denmark ..... 1902/78

[51] Int. Cl.[2] ..... A63H 33/08
[52] U.S. Cl. ..... 46/22; 46/32
[58] Field of Search ..... 46/16–32

[56] References Cited

U.S. PATENT DOCUMENTS

| | | | |
|---|---|---|---|
| 3,005,282 | 10/1961 | Christiansen | 46/22 |
| 3,034,254 | 5/1962 | Christiansen | 46/22 |
| 3,811,218 | 5/1974 | Salmon et al. | 46/17 |
| 3,870,312 | 3/1975 | Hamar | 46/22 |
| 3,995,395 | 12/1976 | Rahmstorf | 46/22 |
| 4,028,844 | 6/1977 | Piperiksen et al. | 46/22 |

FOREIGN PATENT DOCUMENTS 2458084 5/1978 Fed. Rep. of Germany .

*Primary Examiner*—Houston S. Bell, Jr.
*Attorney, Agent, or Firm*—Stevens, Davis, Miller & Mosher

[57] ABSTRACT

A toy figure, adapted to be detachably mounted on a base plate pertaining to a toy building set and provided with coupling studs, is provided with a leg assembly comprising a pair of identical leg elements having substantially plane rear faces (calves). Recesses comprising lengthwise extending channels or pairs of holes are provided in the rear faces of the leg elements, and the width of these recesses is substantially equal to the width of the studs of the base plate. The recesses are symmetrical with respect to the lengthwise extending median plane of the leg elements and, in the position of the leg elements wherein their rear faces coincide, the distance between the axes of symmetry of the recesses is equal to the module m of the building set.

1 Claim, 13 Drawing Figures

TOY FIGURE

This invention generally relates to toy figures and, more particularly, to a toy figure which is adapted to be used as a component in a toy building set composed of building blocks and other elements provided with coupling means for detachably interconnecting adjacent blocks or other components.

PRIOR ART

Toy building sets of the kind referred to are well-known in prior art, and a typical example of such toy building sets is described in the U.S. Pat. Nos. 3,005,282 and 3,034,254.

More recently, it has been suggested to supplement the known building sets with dolls and similar toy figures provided with movable limbs and coupling means for detachably connecting them to other components of the building set.

As an example of prior art relating to assemblable toy figures reference may be had to U.S. Pat. No. 3,995,395 and the various patents cited therein.

The most relevant prior art, however, are the toy figures manufactured by the applicants as accessories to their toy building sets. These dolls are well suited for mounting on a base plate pertaining to the building set, and the present invention is concerned with a toy figure of this kind.

SUMMARY OF THE INVENTION

The main object of the invention is to improve and supplement the coupling means that have so far been used for detachably interconnecting the toy figures with the base plates of the building set.

According to the invention, this improvement enables the figure to be mounted in many different positions relatively to the base plate and, in particular, in both upright and seated positions, and this object is achieved by providing recesses in the leg members of the figure, the characteristic features of which will be more fully described with reference to the drawings and defined in the claims.

Two embodiments of a toy figure according to the invention will be described in the following with reference to the drawings, and the common features of the invention, which apply to both embodiments, are the following:

a leg assembly comprising a pair of identical leg members having substantially flat rear faces (calves) which are provided with recesses;

each leg member is provided with a foot part and with recesses therein;

each of the recesses is designed as coupling means for detachably interconnecting the leg members with coupling studs on a base plate pertaining to a building set having a module m equal to the distance between the axes of adjacent studs, so as to enable the figure to be detachably mounted on the base plate in both seated and upright positions;

the width of the recesses is equal to the width of the coupling studs of the base plate and each recess is symmetrical with respect to an axis extending in the lengthwise direction of the leg member and of the foot part respectively, and the distance between the axes of symmetry in the position of the leg members, wherein the planes of their flat rear faces (calves) coincide, is equal to the module m of the building set.

BRIEF DESCRIPTION OF THE DRAWINGS

The first embodiment is illustrated in FIGS. 1–7, wherein.

The second embodiment is illustrated in FIGS. 8–13, wherein

Figure 1:
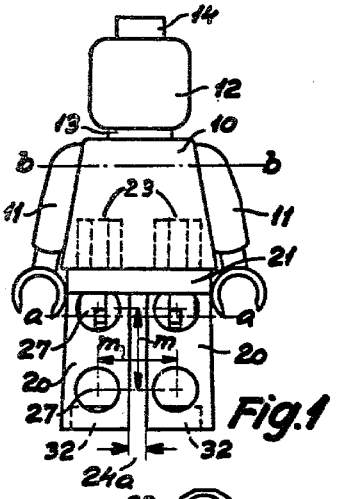
FIG. 1 is a rear elevation of the figure showing the back and the rear face of the leg members in an upright position.
Figure 8:
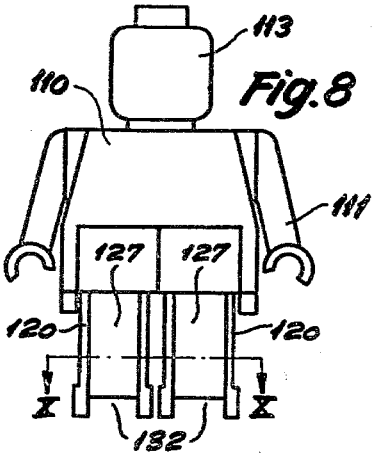

FIG. 8 is a rear elevation similar to FIG. 1 showing a modified form of the rear face of the leg members.

Figure 9:
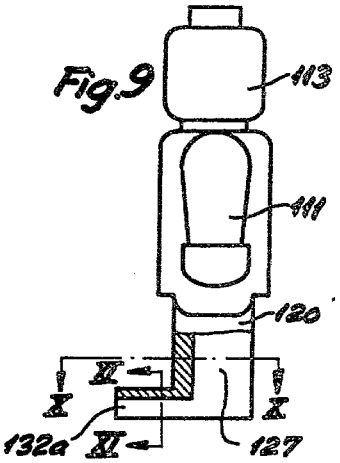

FIG. 9 is a side elevation of the same FIGURE, partly in vertical section.

Figure 10:
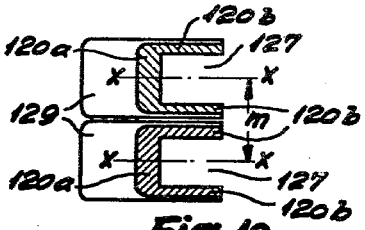

FIG. 10 is a sectional view taken on the line X—X of FIG. 8.

Figure 11:
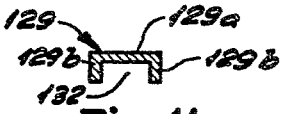

FIG. 11 is a sectional view taken on the line XI—XI of FIG. 9.

Figure 12:
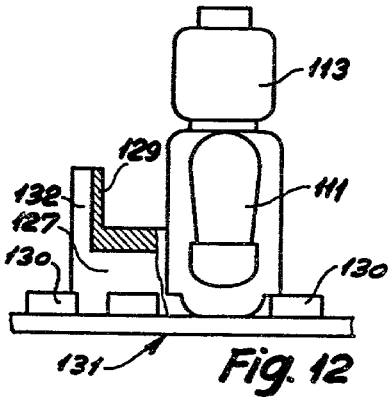

FIG. 12 is a side elevation, partly in vertical section, showing the figure of FIGS. 8 and 9 in a seated position on a base plate.

Figure 13:
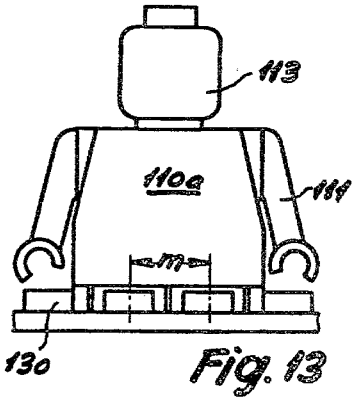

FIG. 13 is a rear elevation of the figure shown in FIG. 12.

DESCRIPTION OF THE EMBODIMENTS

Referring now to FIGS. 1–7, the toy figure of this embodiment comprises a body member 10 having a pair of arms 11 pivotally mounted on the body member around a horizontal axis b—b. The upper portion of the body member 10 is provided with a neck portion 13 and a head 12 mounted thereon and comprising a coupling stud 14 for detachable interconnection with elements pertaining to a toy building set.

The body member 10 comprises a cavity adapted to receive a pair of coupling studs 23 on the top face of a connecting plate 21, the bottom face of which is formed with a cylindrical cavity 22 adapted to provide a concave bearing face for a corresponding convex upper face **20*d* of a pair of identical leg members 20 having side faces 20*a* and 20*b* and a substantially flat rear face (calf) 20*c*. In the middle of the bottom face 22 of the connecting plate 21 there is provided a substantially disc-shaped holder 24 having a pair of laterally extending pivots 25 for pivotally mounting the leg members 20 on the connecting plate 21. A bore 28 is provided in one side face 28*a* of the upper cylindrical portion of the leg members co-axially with the cylindrical faces 20*d* and 22 for pivotally mounting the leg members 20 on the pivots 25. Projections 26 adjacent the ends of the pivots 25** provide for a snap locking effect when mounting the leg members on the pivots.

In this embodiment, the recesses in the flat rear face (calf) of the leg members comprise two identical circular bores 27 in each leg member, and the distance between the centers of these bores is equal to the module m of the building set, i.e. to the distance between the axes of a pair of adjacent coupling studs 30 on a base plate 31 pertaining to the building set. Moreover, the width of the disc 24 between the leg members 20 is such that, in the position shown in FIG. 1 where the planes of the rear faces 20*c* coincide, the lateral distance between the centers of the bores 27 is also equal to the module m of the building set. In this position, therefore, the four bores 27 define a square, the side of which is equal to the module m, which enable the figure to be mounted in a seated position on two adjacent pairs of the studs 30 of the base plate 31, as shown in FIG. 2.

In order that the figure of this embodiment may also be mounted in an upright position on the base plate 31, the leg members comprise foot parts 29, the bottom face (sole) of which are provided with recesses 32 adapted to be detachably connected to the studs 30 of the base plate 31.

Referring next to FIGS. 8–13, the embodiment shown therein will in most cases be the preferred embodiment, because it enables the toy figures to be moved relatively to the base plate instead of being locked to the studs, as explained with reference to the first embodiment illustrated in FIGS. 1–7. Whether or not it is of particular importance to provide for a slideable or rocking interconnection between a toy figure and its base plate is chiefly a matter of choice, but it is generally considered that most children will prefer the toy figure to be moveable relatively to the base plate and, therefore, the embodiment according to FIGS. 8–13 will be referred to as the preferred embodiment.

Figure 2:
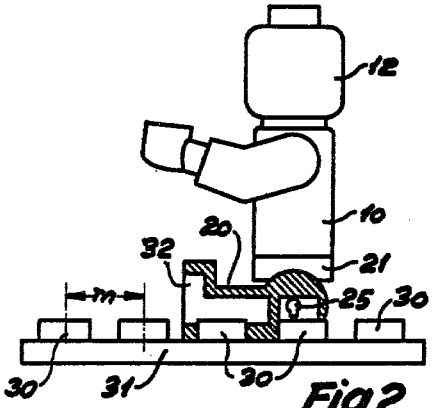
FIG. 2 is a side view showing the same figure in a seated position.
Figure 3:
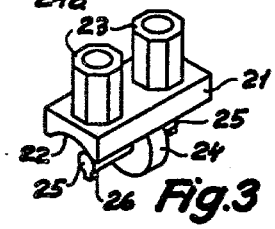
FIG. 3 is a perspective view of a connecting plate for detachably mounting the leg members in the body member of the figure.
Figure 4:
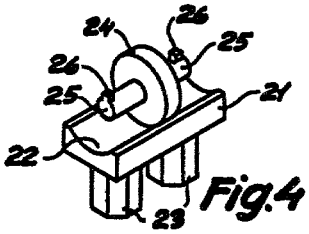
FIG. 4 is a similar perspective view showing the lower face of the connecting plate.
Figure 5:
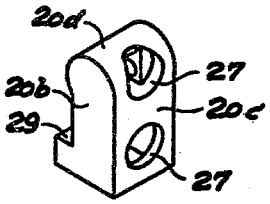
FIG. 5 is a perspective view of a leg member showing the rear face and one side face thereof.
Figure 6:
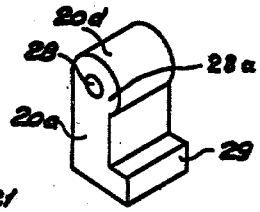
FIG. 6 is a similar perspective view showing the front face and the other side face of the leg member.
Figure 7:
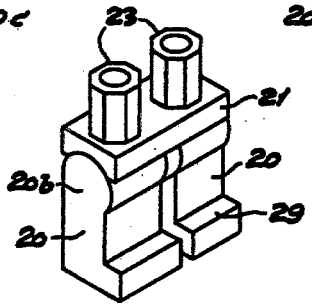
FIG. 7 is a perspective view showing the leg assembly comprising a pair of identical leg members mounted on the connecting plate of FIGS. 3 and 4.

In this embodiment, the reference numbers are composed of three digits, i.e. the first digit "1" followed by a number comprising two digits which designate the reference number of the equivalent parts shown in FIGS. 1–7. Thus, the body 10 of FIGS. 1 and 2 is designated as 110 in FIGS. 8, 9, 12 and 13, the leg members 20 of FIGS. 1–7 are designated as 120 in FIGS. 8–13. And so on.

The characteristic feature of the preferred embodiment, shown in FIGS. 8–13, is that the recesses in the calves of the leg members 120 and in the soles of the foot parts 129 are channels or grooves 127 and 132 respectively. As shown in FIG. 10, the channels 127 are symmetrical with respect to lengthwise extending mediam planes x—x which are interspaced at a distance which is equal to the module m of the building set, and the width of these channels is substantially equal to the width of the coupling studs 130 of the base plate 131, shown in FIGS. 12 and 13. Likewise, the recesses in the foot parts 129 are formed as channels 132 which extend in the lengthwise direction of the foot parts and hence at right angles to the recesses 127 of the leg members 120, the width of the channels 132 being also equal to the width of the studs 130.

As shown in FIG. 9, the channels 132 in the foot parts 129 may be open at the front end 132*a*, so as to enable the figure in the upright position to slide along two rows of studs 130 of the base plate. In the seated position of FIGS. 12 and 13, the figure is slideably mounted on the base plate along an adjacent pair of rows of studs 130 which engage the channels 127.

As shown in FIGS. 10 and 11, the leg members 120 comprise a front face 120*a* and two side faces 120*b*, and the foot members 129 comprise a top face 129*a* and two side faces 129*b*.

What is claimed is:

1. In a toy figure pertaining to a building set and adapted to be detachably mounted in an upright position on a base plate, provided with a plurality of coupling studs uniformly spaced apart in both longitudinal and transverse directions, so that two pairs of adjacent studs define a square in which the distance between the axes of adjacent studs is equal to the module m of the building set, said toy figure including a head, a body, a pair of arms and a pair of legs provided with foot parts each having a plane bottom face (sole) including recesses for detachably mounting the figure in an upright position on a pair of studs of the base plate, the improvement which comprises a leg assembly in which the legs have substantially flat rear faces (calves), connecting means having a top face provided with upwardly extending coupling means for connecting the leg assembly with the body of the figure and a concave bottom face, a pivot pin holder extending downwardly from the bottom face of said connecting means, a pair of pivot pins extending transversely from the pivot pin holder at either side thereof, leg members being pivotally mounted on the respective pivot pins each leg member having a convex top face for slidable contact with the concave bottom face of the connecting plate, and the rear face (calf) of each leg member being provided with a pair of identical cylindrical bores for detachably mounting the toy figure in a seated position on a pair of studs of the base plate, the axes of said bores in each leg member being disposed so as to define a plane extending in the lengthwise direction of the leg member, the distances between the said axes and between the said planes being equal to the module m of the building set.

* * * * *